United States Patent [19]

Rumps

[11] 4,286,836

[45] Sep. 1, 1981

[54] CONNECTOR BLOCK WITH STRAIN PREVENTION

[75] Inventor: Norbert A. Rumps, Norridge, Ill.

[73] Assignee: Teletype Corporation, Skokie, Ill.

[21] Appl. No.: 58,239

[22] Filed: Jul. 17, 1979

[51] Int. Cl.[3] ..... H01R 4/24

[52] U.S. Cl. ..... 339/97 R; 339/103 R; 339/103 M

[58] Field of Search ..... 241/97 R, 98, 99 R, 241/103 R, 103 M, 105, 106, 107

[56] References Cited

U.S. PATENT DOCUMENTS

| | | | |
|---|---|---|---|
| 3,617,615 | 11/1971 | Balzer | 339/107 X |
| 3,854,114 | 12/1974 | Kloth et al. | 339/97 R |
| 3,936,128 | 2/1976 | D'Annessa et al. | 339/103 M X |
| 3,979,099 | 4/1975 | Shaffer | 339/107 X |

OTHER PUBLICATIONS

AMP Data Sheet, 78-481, issued 10-78.

*Primary Examiner*—Mark Rosenbaum

*Attorney, Agent, or Firm*—W. K. Serp; J. C. Albrecht

[57] ABSTRACT

A connector block body of nonconductive material has a row of spaced open cavities. Within each cavity there is mounted an insulation displacement connector in the form of a metallic cylinder having a longitudinal slit. One wall of each of the cavities has a first slot extending from the cavity opening. The width of the first slot is slightly less than the diameter of the insulated wire for which the connector block is designed. A stuffer cap, which is attached to the block by a tether, has an open cavity. Mounted within the cavity of the cap is a post for engaging and forcing an insulated wire into the slit of the connector. Additionally, one wall of the cap has a slot and a cooperating nib which engage the wire and force it in the first slot wherein the wire is tightly grasped to prevent strain. In a second embodiment of the invention, a flat plate, bifurcated to define a restricted slit, is used as the connector. In lieu of the post, the cap in this embodiment has a ridge which engages the insulated wire forcing it into the slit of the plate.

7 Claims, 5 Drawing Figures

FIG. 1
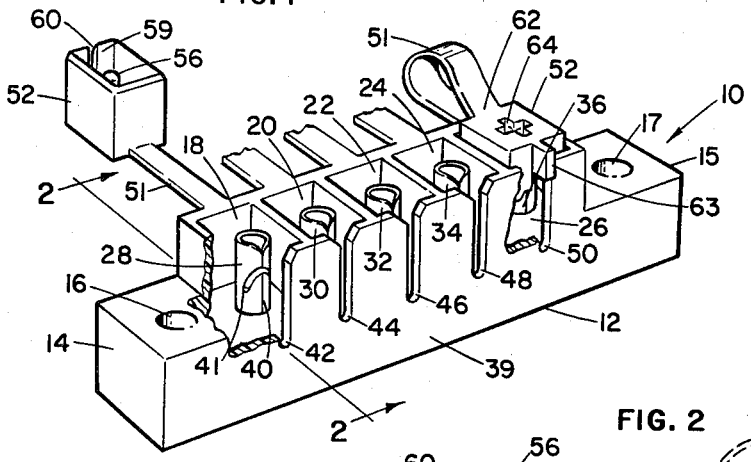
FIG. 2
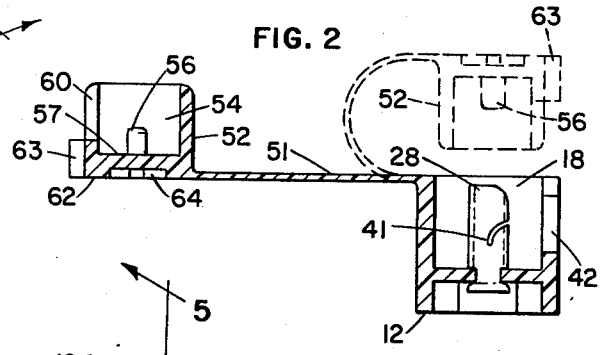
FIG. 3
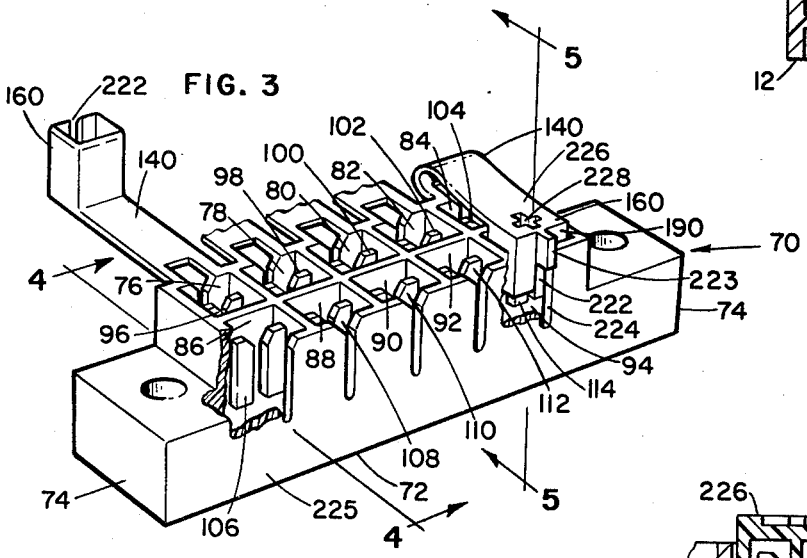
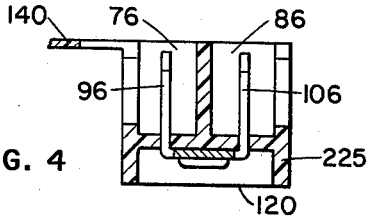
FIG. 4
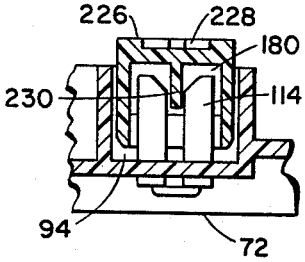
FIG. 5

CONNECTOR BLOCK WITH STRAIN PREVENTION

DESCRIPTION

1. Technical Field

This invention relates to a connector block with means for preventing strain to the wires connected thereto.

2. Background Art

A connector block provides a convenient means for connecting two or more wires or for connecting insulated wire to equipment. As used hereinafter the term wire refers to an insulated wire having an electrical conductor covered with a coating of insulation. A frequently used type of connector block employs a body of insulating material with a row of separated screw terminals imbedded therein. The wire or wires to be connected are stripped and wrapped about a screw and tightened down with a screwdriver. It will be appreciated that this procedure requires considerable time and is therefore relatively expensive. To reduce the time involved in individually stripping the insulation from each wire and forming the conductor, insulation displacement connectors are available. With such connectors, a connection is formed by forcing an insulated wire into the connector by means of a specially designed tool. The necessity of using such special tooling is particularly costly where field connections are produced by repairmen since, under such conditions, each repairman must be provided with an installation tool. One particular type of insulation displacement connector sold by AMP Incorporated is sold under the trademark AMP-BARREL and is described in their data sheet 78-481, Number 7 issued October 1978. Their connector is in the shape of an end supported hollow metallic cylinder having a narrow longitudinal slit with a portion of the edges of the slit serrated to cut the insulation from a wire as it is forced into the slit. A second type of insulation displacement connector is sold by Berg Electronics, a division of E. I. Du Pont De Nemours and Company, Incorporated. This connector utilizes an upright metallic plate bifurcated to define an elongated slit. An insulated wire is forced into the slit by a special staking tool and the edges of the slit cut the insulation from the wire and thus make contact with the conductor of the insulated wire. It will be appreciated that when a wire is inserted into either of these connectors, the conductor is tightly held by the edges which define the slit and may be slightly cut during installation. This condition weakens the conductor at the location of the cut so that subsequent flexing of the conductor may result in breakage.

The hereinafter described embodiments provide connector blocks with insulation displacement connectors which are easily used in the field and do not require special installation tools. Further, the illustrated embodiments include strain prevention for the wires which greatly reduces the possibility of conductor breakage.

SUMMARY OF THE INVENTION

In accordance with the present invention, a connector block is provided having at least one connector for connection to the conductor of an insulated wire. The connector block comprises a body having a first open cavity with said connector securely mounted therein. At least a first wall of each first cavity has an elongated first slot, the width of which is less than the minimum diameter of the wire for which the block is to be used. A wire, when connected to the connector, is forced into the slot so as to provide strain relief to the connection.

More particularly, the block is constructed of a material having electrical insulating properties and the connector is an insulation displacement connector. Additionally, a cap is attached to the block by a tether. The cap is shaped to engage a wire positioned adjacent the connector and used to force the wire into the insulation displacement connector so as to complete an electrical connection to the conductor of the wire. Preferably, the cap includes a first wall having a second slot which serves to freely engage a wire positioned adjacent the first slot and to force the wire into the first slot so as to prevent strain on the wire.

DRAWINGS

FIG. 1 is a connector block according to a first embodiment of this invention with a portion broken away for clarity of illustration;

FIG. 2 is a sectional view of the connector block of FIG. 1 along the line 2—2.

FIG. 3 is an alternative embodiment of a connector block with a portion broken away for clarity of illustration;

FIG. 4 is a sectional view of the connector block of FIG. 3 along the line 4—4; and FIG. 5 is still another sectional view of the connector block of FIG. 3 along the line 5—5.

DETAILED DESCRIPTION

First Embodiment

With particular reference to FIG. 1, a connector block 10 is illustrated including a rectangularly shaped body 12. Extending from the ends of the body 12 are mounting lugs 14, 15 which have openings 16, 17 for receiving the shank of a screw or other mounting fastener (not shown). The upwardly disposed surface of the block 12 has a plurality of spaced rectangularly shaped cavities 18, 20, 22, 24 and 26. Positioned within each of the cavities 18–26 are respectively insulation displacement connectors 28, 30, 32, 34 and 36. To simplify description, the connector 28 will be described in detail and it will be appreciated that the remaining connectors 30–36 are similarly constructed. The connector 28 is in the form of a hollow metallic cylinder which has a longitudinal slit 40. Additionally, approximately one-third of the way down from the top of the connector 28 there is a transverse slit 41 oriented generally normal to the longitudinal slit 40. The connector 28 is securely staked at the bottom of its cavity 18 with an open end of the cylinder disposed upwardly toward the cavity opening as shown in FIG. 2. Alternatively, the base of the cylinder 28 may extend below the bottom of the block 12 for connection to a printed circuit board (not shown). The connector 28 is positioned with the longitudinal slit 40 directed toward a front surface 39 of the block 12. Cut through the wall of each of the cavities 18–26 are strain prevention slots 42, 44, 46, 48 and 50. The width of each of the slots 42–50 is less than the minimum diameter of the insulated wire which the connector block 12 is designed to accommodate. Each of the slots 42–50 are centrally positioned in their respective cavity walls and commence at the opening and extend downwardly.

Attached to the body 12 by means of a tether 51 and serving to facilitate connection between the connector 28 and a selected insulated wire is a stuffer cap 52. Each of the cavities 18–26 is associated with a stuffer cap. The stuffer cap 52 associated with the cavity 18 is illustrated in FIG. 2 and will hereinafter be described in greater detail. The cap 52 displays a generally rectangular shape and is in the form of a cup having a cavity 54. The overall dimensions of the cap 52 are slightly less than the dimensions of the cavity 18 to permit ready insertion of the cap 52 therein. Firmly mounted and centered within the cavity 54 is a cylindrical post 56 the diameter of which is slightly less than the inner diameter of the hollow cylinder of the connector 28 thereby permitting insertion of the post 56 therein.

As previously mentioned, the connectors 28–36 are similar to the AMP-BARREL connector by AMP Inc. A particular feature of this connector is its ability to accommodate two wires of different diameters. The first wire (not shown) is forced into the longitudinal slit 40 until it is just above the transverse slit 41 with the upper portion of the cylinder cutting the insulation and making contact with the conductor of the wire. A second conductor (not shown) when inserted in the slit of the connector 28 is similarly forced down to a location just above the transverse slit 41. As the second conductor is forced into the slit 40, the first wire is displaced downward until it comes to rest just below the transverse slit 41 and the lower portion of the connector 28 grasps and completes contact with the conductor of the first wire. It will be appreciated that isolated portions of the connector 28 grasp each of the wires thus allowing two wires of different diameters to be accommodated.

Referring to the stuffer cap 52, the length of the post 56 is less by the diameter of the insulated wire (not shown) than the distance between the top of the connector and the point where the transverse slit 41 intersects the longitudinal slit 40. Thus, when the cap 52 is positioned and forced into the cavity 26, the top of the connector 36 abuts an upper wall 57 of the cavity 54 of the cap 53 and the post 56 stuffs the wire (not shown) into the connector 28. A wall 59 of the cap 52 has a notch 60 which engages the wire placed in the cavity 26 and forces the wire into the associated strain relief slot 42 in the wall 39. To assure complete entry of the wire into the restricted slot 42, a nib 63 shaped to freely fit into the slot 42 projects from the outer surface of the wall 59 of the cap 52 and is located above the slot 60. To facilitate application of the necessary downward force to the cap 52, the top surface 62 has a recessed cross 64 therein for receiving the blade of a standard or a phillips screwdriver (not shown). If the insertion of a second wire is desired, the stuffer cap 52 is removed and the second wire (not shown) is positioned on the connector. The cap 52 is replaced and again the post 56 is forced down into the connector 28. As the second wire moves downwardly, it forces the first wire below the transverse slit 41 of the connector 28 and deeper into the strain relief notch 42. Preferably, after the connection is completed, the stuffer cap 52 is allowed to remain lodged in the cavity 18. This feature provides two advantages. Firstly, the cap 52 completely insulates the connector 28 preventing any accidental contact by and possible shock to the installer. Secondly, the cap 52, when allowed to remain over the connector 28, serves to prevent dirt and other contaminants from impairing the connection thus completed.

Second Embodiment

In FIG. 3, a second embodiment is illustrated which utilizes the aforementioned Berg Electronics insulation displacement connector. The connector block 70 includes a body 72 having mounting ears 74 and two rows 76–84, 86–94 of equally spaced cavities. Each cavity 76–84 of the first row is adjacent a companion cavity 86–94 of the second row. Positioned within each cavity is an insulation displacement connector 96–104, 106–114. For purposes of discussion, the connectors 96 and 106, located respectively in cavities 76 and 86, will be considered in detail. The connector 96 is in the form of a bifurcated upright plate with the two connectors 96 and 106 located in companion cavities 76 and 86 and connected by a conductive strap 120. The remaining connectors 98–104, 108–114 are similarly configured. Associated with each pair of cavities and attached to the block 72 by a flexible tether 140 is a stuffer cap 160 having an overall appearance similar to the cap 52 of the previous embodiment. For purposes of illustration, the cap 160 will be described in detail and the remaining stuffer caps are similarly constructed. The cap 160 (FIG. 5) has an open cavity 180. A front wall 190 of the cap 160 has a slot 222 which will align with a slot 224 in the front surface 225 of the block 72. A nib 223, which projects from the cap 160, assures entry of the insulated wire into the slot 224. In the upper surface 226 of the cap 160 there is a cross shaped recess 228 for receiving the blade of a screwdriver during installation.

FIG. 5, particularly displays the internal structure of the stuffer cap 160. As shown, the upper inner surface of the cavity 180 carries a longitudinally oriented raised ridge 230 for engaging a wire (not shown) and forcing it into the slit defined by the prongs of the connector 114. When a wire is positioned between the prongs of the connector 114, the cap 160 is forced into the cavity and the ridge 230 engages the wire stuffing it between the prongs of the connector 114 and the recesses 222 in cooperation with the nib 223 forces and guides the wire into the restricted strain relief slot 224. For connection to the connectors 96–104 an insulated wire (not shown) is positioned on the connector 104 and forced downwardly with a special staking tool. As the wire is forced between the prongs of the connector 104, the insulation on the wire is cut by the edges defining the slit thus completing a connection to the conductor of the wire. This connection requires the use of a special staking tool and thus will normally be made at an equipment manufacturing facility. The connectors 106–114 are suitable for field installation. The installer positions the end of an insulated wire into the top of the slit defined by the selected connector 106–114 and forces the associated stuffer cap downwardly by applying a force with a screwdriver or other suitable tool. Preferably, the cap is left in position in the cavity thus providing an insulated, protected connection.

A connector block has been described which provides a rapid means of interconnecting wires and of connecting a wire to equipment. Additionally, the connector block includes a means for effecting an electrical connection without the use of special installation tools and for maintaining a clean, insulated contact relatively free of mechanical strain. Other features and advantages of this invention will be more readily apparent after reference to the following claims:

What is claimed is:

1. A connector block 10 having an insulation displacement connector 28, 114 for connection to an insulated wire, the connector block 10 is constructed of a material having electrical insulating properties and includes a body 12, 72 having an open first cavity 18, 94 with said connector 28 securely mounted therein, at least a first wall defining said first cavity has an elongated first slot 42, 224 extending from the opening of said first cavity toward the base of said first cavity, the width of said first slot being less than the minimum diameter of the insulated wire for which the connector block 12, 72 is to be used, characterized in that:

a cap defining a projecting member 56, 230 located within said second cavity, said projecting member 52 having a second cavity is attached to said block by a tether 51, said cap being shaped to engage a wire positioned adjacent said connector 28 and to force the wire into said connector so as to complete an electrical connection to the conductor of a wire, said cap 52 includes a first wall having a second slot 60 for engaging a wire positioned adjacent said first slot 42, 224 and forcing the wire into said first slot so that when a wire is connected to said connector and forced into said first slot, strain on the conductor of said wire at the connection will be prevented.

2. The connector block of claim 1, characterized in that:

a nib 63 projects from the outer surface of said first wall adjacent the end of said second slot 60 and serves to assure that the wire is forced into said first slot 42.

3. The connector block of claim 1, characterized in that:

said connector comprises a longitudinally slotted hollow cylinder 28 mounted within a first cavity in said block 12 with an open end disposed toward the open end of said first cavity 18, said projecting member is in the form of a post 56 mounted within said second cavity in said cap, and extending toward the opening of said second cavity, and said post 56 being of a diameter to fit into said cylinder 28, so as to force a wire into said slit 40 defined by said cylinder.

4. The connector block of claim 3, characterized in that:

the outer surface of said cap has at least one recess 64, suitable for receiving the blade of a screwdriver.

5. The connector block of claim 1, further characterized in that:

said connector 114 is mounted within said first cavity 94 and is in the form of a bifurcated plate 114 defining a slit, said plate 114 being mounted to extend toward the opening of said first cavity and said projecting member is in the form of a raised ridge 230 within said second cavity 180, said ridge being positioned to enter said slit when the cap 160 is placed over said plate 114 so as to force a wire into said slit.

6. The connector block of claim 5, further characterized in that:

the outer surface of said cap has at least one recess 228 suitable for receiving the blade of a screwdriver.

7. The connector block of claim 5, further characterized in that:

said body has at least two adjacent first and third cavities 84, 94 each having a bifurcated plate 104, 114 mounted therein and conductive means 120 connecting said two plates so as to provide an electrical connection therebetween.

* * * * *